US007549525B2

(12) United States Patent
Bell et al.

(10) Patent No.: US 7,549,525 B2
(45) Date of Patent: Jun. 23, 2009

(54) MONEY ITEM ACCEPTOR WITH ENHANCED SECURITY

(75) Inventors: Malcolm Reginald Hallas Bell, Leeds (GB); Andrew William Barson, Stockport (GB); Kevin Charles Mulvey, Warrington (GB)

(73) Assignee: Money Controls Limited, Oldham (GB)

( * ) Notice: Subject to any disclaimer, the term of this patent is extended or adjusted under 35 U.S.C. 154(b) by 547 days.

(21) Appl. No.: 10/537,572

(22) PCT Filed: Jan. 9, 2004

(86) PCT No.: PCT/GB2004/000070

§ 371 (c)(1), (2), (4) Date: Jun. 3, 2005

(87) PCT Pub. No.: WO2004/063995

PCT Pub. Date: Jul. 29, 2004

(65) Prior Publication Data

US 2006/0243558 A1 Nov. 2, 2006

(30) Foreign Application Priority Data

Jan. 10, 2003 (GB) ..... 0300633.5

(51) Int. Cl.
*G07G 3/00* (2006.01)
*G07D 7/00* (2006.01)

(52) U.S. Cl. ..... 194/202

(58) Field of Classification Search ..... 194/202, 194/217

See application file for complete search history.

(56) References Cited

U.S. PATENT DOCUMENTS 5,355,989 A 10/1994 Best

FOREIGN PATENT DOCUMENTS

| | | |
|---|---|---|
| EP | 1156458 | 11/2001 |
| GB | 2169429 | 7/1986 |
| WO | WO 00/48138 | 8/2000 |

*Primary Examiner*—Patrick H Mackey
*Assistant Examiner*—Mark Hagerman
(74) *Attorney, Agent, or Firm*—Orrick, Herrington & Sutcliffe LLP

(57) ABSTRACT

An acceptor for money items such as coins or banknotes produces a money item parameter signal ($x_1$) depending on a sensed characteristic of the money item. A store (12) provides window data corresponding to normal acceptance ranges of values of the parameter signal for a money item of a particular denomination (NAW), as well as restricted acceptance windows (RAW). A processor (11) determines when an occurrence of the parameter signal ($x_1$) may represent a fraudulent money item and then for subsequent sensed money items compares the value of the parameter signals ($x_1$) with the restricted acceptance range (RAW). The RAW range is used until n successive true coins are inserted or a time t has lapsed. After a fraudulent attempt, the values of n and t are increased so that a fraudster cannot then insert n true coins or wait a time t and attempt another fraudulent coin insertion. Also, a focused rejection window (FRW) rejects coins with suspiciously close parameter signals, which could form part of a counterfeit set.

11 Claims, 6 Drawing Sheets

Figure 3b

MONEY ITEM ACCEPTOR WITH ENHANCED SECURITY

FIELD OF THE INVENTION

This invention relates to an acceptor for money items such as coins and banknotes and has particular but not exclusive application to a multi-denomination acceptor.

BACKGROUND

Coin and banknote acceptors are well known. One example of a coin acceptor is described in our GB-A-2 169 429. The acceptor includes a coin rundown path along which coins pass through a coin sensing station at which sensor coils perform a series of inductive tests on the coins in order to develop coin parameter signals which are indicative of the material and metallic content of the coin under test. The coin parameter signals are digitised and compared with stored coin data by means of a microcontroller to determine the acceptability or otherwise of the test coin. If the coin is found to be acceptable, the microcontroller operates an accept gate so that the coin is directed to an accept path. Otherwise, the accept gate remains inoperative and the coin is directed to a reject path.

In banknote validators, sensors detect characteristics of the banknote. For example, optical detectors can be used to detect the geometrical size of the banknote, its spectral response to a light source in transmission or reflection, or the presence of magnetic printing ink can be detected with an appropriate sensor. The parameter signals thus developed are digitised and compared with stored values in a similar way to the previously described prior art coin acceptor. The acceptability of the banknote is determined on the basis of the results of the comparison.

When a number of coins or banknotes of the same denomination are passed through an acceptor, successive values of coin or banknote parameter data are thus developed. When the distribution of the values of these signals is plotted as a graph, the result is a bell curve, with a central peak and tails on opposite sides. The shape of the graph may typically although not necessarily be Gaussian.

The distribution illustrates that for a money item, such as a coin or banknote of a particular denomination, the most probable value of the corresponding parameter signal lies at the peak of the bell curve, with a decreasing probability to either side. In prior coin and banknote validators, data is stored in a memory, corresponding to acceptable ranges of parameter signal for a particular denomination. The acceptor thus compares the value for a coin or banknote under test with the stored data to determine authenticity. The data may define windows in terms of upper and lower limit values, or as a mean value and a standard deviation, such that the window comprises a predetermined number of standard deviations about the mean. By making the stored windows narrow, an increased discrimination is provided between true money items and frauds. However, if the windows are made too narrow, the rejection rate of true money items increases, disadvantageously. The width of the windows is thus selected as a compromise between these two factors. Attempts to defraud coin or banknote validators typically involve the manufacture of facsimile coins or banknotes which cause the acceptor to produce parameter signals which lie within the stored acceptance windows.

In U.S. Pat. No. 5,355,989, a coin acceptor is described which switches from using a first normal acceptance window for a true coin, to a second narrower window when a coin parameter signal produced by testing a coin falls in a region of the normal window for the true coin corresponding to a low acceptance probability region for the coin concerned. A group of fraudulent coins may all have similar characteristics and they may cause the validator to produce parameter signals which lie within the normal window, but the parameter signals consistently have a value which is not centred on the high probability peak region of the window associated with the true coin but instead are centred on the lower probability tail regions of the bell curve distribution within the normal window. When the parameter signal falls within this low probability region, the second narrower window is then used for the next tested coin. If the next coin has a parameter falling in the narrower window it is a true coin but if not, it is a fraud which should be rejected. This approach seeks to prevent frauds carried out by the use of coins of a particular low value denomination, from a foreign currency set, with characteristics that correspond but are not exactly the same as a high value coin of the currency set that the acceptor is designed to accept. It will be understood that the foreign denomination coins exhibit their own generally Gaussian distribution of parameter signals, and if the low probability or tail region of this distribution partially overlaps a corresponding region of the distribution for the true coin that the acceptor is designed to accept, then the low value foreign coins will sometimes be accepted as true coins.

However, significant problems are unresolved by U.S. Pat. No. 5,355,989. In the disclosed arrangement, when a true coin is inserted, the system switches back from the second narrower window to the first normal acceptance window. If the next coin inserted is a foreign currency coin, if it has a parameter signal within the normal acceptance window, it will be accepted although the system will then switch to the second narrower window for the next coin under test. If the next coin tested is a true coin, it will be accepted and the system will switch back to the first window. The US Patent considers the possibility of counting groups of n coins before making the switch between the windows. Thus, with this system, it is possible to obtain acceptance of a significant number of foreign currency coins by alternating them with true coins either individually or in equal numbered groups of n coins. A further disadvantage is that the system is very slow because the foreign coins do not all produce an acceptance and so when a fraudster is attempting to use foreign coins they may be rejected a number of times as a result of falling outside of the first relatively wide acceptance window. However, the prior validator takes no account of the fraud attempt and will only respond when a fraudulent coin is in fact accepted.

WO 00/48138 discloses an arrangement to overcome these problems. In one embodiment, two security barrier ranges are introduced which lie outside the normal acceptance window. These security barrier ranges can be generally aligned with the peak of the distribution for the fraudulent coin. Even if the fraudulent coin produces a parameter signal outside of the normal acceptance window, should the parameter be within these barriers, the existence of the fraud attempt is detected, the coin is rejected, and the acceptor switches to the narrower acceptance window to reduce the risk of fraud.

In addition, WO 00/48138 discloses that in the event of a possible fraudulent attempt, the system is operable to compare any subsequent occurrences of the parameter signal with the narrower window for a predetermined time and then to revert to the normal acceptance window. Hence merely inserting a set number of true coins directly after a foreign coin will not then result in the system reverting to the normal acceptance window; a certain time must also have elapsed.

In spite of the more complex arrangement disclosed in WO 00/48138, the money item acceptor described therein has some shortfalls. A perseverant fraudster could make repeated fraudulent attempts and thus determine the number of true coins to be inserted or the amount of time to have lapsed before the use of the normal acceptance window is resumed. Also, particularly good counterfeit money items could be produced which when inserted into the money acceptor produce a Gaussian output with a narrow peak inside even the narrower acceptance window.

SUMMARY OF THE INVENTION

The invention seeks to overcome these problems. In accordance with the invention from a first aspect there is provided a money item acceptor comprising: a signal source to produce a money item parameter signal as a function of a sensed characteristic of a money item, a store to provide data corresponding to a normal acceptance range of values of the parameter signal for a money item of a particular denomination, the range including relatively high and low acceptance probability regions wherein the value of a parameter signal corresponds to a relatively high or low probability of an occurrence of a sensed money item of said particular denomination, and a processor configuration operable to determine when an occurrence of the parameter signal corresponding to a first money item adopts a predetermined value relationship, and in response thereto, to compare the value of a subsequent occurrence of the parameter signal corresponding to a second money item with data corresponding to a restricted acceptance range as compared with the normal acceptance range, and to provide an output corresponding to acceptability of the second money item if the second occurrence of the parameter signal falls within said restricted acceptance range, said processor being operable to compare subsequent occurrences of the parameter signal with the restricted acceptance range, and if a first number of them correspond to acceptable money items, to revert to the normal acceptance range, wherein, the processor is operable after reverting to the normal acceptance range and in response to a subsequent money item parameter signal adopting said predetermined value relationship, to compare subsequent occurrences of the parameter signal with the restricted acceptance range and if a second number of them correspond to acceptable money items, to revert to the normal acceptance range again, the second number being different from the first number.

The money item acceptor may be arranged such that the second number is greater than the first number, and the processor may be operable to increment said first number by a predetermined amount to define said second number. Furthermore a counter may be operable to count said first number and thereafter to count said second number, and the processor may be operable to reset the count counted by the counter to a default count value in the event that there is no occurrence of a money item parameter signal within a predetermined security time period.

The predetermined value relationship may occur when an occurrence of the money item parameter signal has a value within the low acceptance probability range or when an occurrence of the money item parameter signal has a value within a predetermined security barrier range outside of the normal acceptance range.

The processor may be operable to compare occurrences of the money item parameter signal with said restricted acceptance range for a first predetermined time period following an occurrence of the money item parameter signal that has said predetermined value relationship, and then to revert to the normal acceptance range and after reverting to the normal acceptance range to compare occurrences of the money item parameter signal with said restricted acceptance range for a second predetermined time period following an occurrence of the money item parameter signal adopting said predetermined value relationship, and then to revert to the normal acceptance range, said second time period being greater than the first time period.

In accordance with the invention from a second aspect there is provided a money item acceptor comprising: a signal source to produce a money item parameter signal as a function of a sensed characteristic of a money item, a store to provide data corresponding to a normal acceptance range of values of the parameter signal for a money item of a particular denomination, the range including relatively high and low acceptance probability regions wherein the value of a parameter signal corresponds to a relatively high or low probability of an occurrence of a sensed money item of said particular denomination, and a processor configuration operable to determine when an occurrence of the parameter signal corresponding to a first money item adopts a first predetermined value relationship, and in response thereto, to compare the value of a subsequent occurrence of the parameter signal corresponding to a second money item with data corresponding to a restricted acceptance range as compared with the normal acceptance range, and to provide an output corresponding to acceptability of the second money item if the second occurrence of the parameter signal falls within said restricted acceptance range, said processor configuration being further operable to determine when an occurrence of the parameter signal corresponding to a first money item adopts a second predetermined value relationship with a range of values within said low acceptance probability region for a money item of a particular denomination, and in response thereto, to compare the value of a subsequent occurrence of the parameter signal corresponding to a second money item with data corresponding to an internal security range within said restricted acceptance range, and to provide an output corresponding to acceptability of the second money item if the second occurrence of the parameter signal falls outside said internal security range.

The processor configuration may be further operable to determine when a first money item parameter signal adopts said second predetermined value relationship, and in response thereto, to compare subsequent occurrences of the parameter signal with said internal security range, and if a first number of them correspond to acceptable money items, to discontinue comparison with the internal security range of values, and, after discontinuing comparison with the internal security range of values, and in response to a subsequent money item parameter signal adopting said second predetermined value relationship, to compare subsequent occurrences of the parameter signal with said internal security range, and if a second number of them correspond to acceptable money items, to discontinue comparison with the internal security range of values again, the second number being different from the first number.

The money item acceptor of the second aspect may be arranged such that the second number is greater than the first number, and the processor may be operable to increment said first number by a predetermined amount to define said second number. Furthermore a counter may be operable to count said first number and thereafter to count said second number, and the processor may be operable to reset the count counted by the counter to a default count value in the event that there is no occurrence of a money item parameter signal within a predetermined security time period.

The second predetermined value relationship may occur when an occurrence of the money item parameter signal has a value within said range of values within said low acceptance probability region for a money item of a particular denomination.

The processor may be operable to compare occurrences of the money item parameter signal with said internal security range for a first predetermined time period following an occurrence of the money item parameter signal that has said second predetermined value relationship, and then to discontinue comparison with the internal security range, and after discontinuing comparison with the internal security range to compare occurrences of the money item parameter signal with said internal security range for a second predetermined time period following an occurrence of the money item parameter signal adopting said second predetermined value relationship, and then to discontinue comparison with the internal security range again, said second time period being greater than the first time period.

In accordance with the invention from a third aspect there is provided a money item acceptor comprising a signal source to produce a money item parameter signal as a function of a sensed characteristic of a money item under test, a store to provide data corresponding to an acceptance range of values of the parameter signal for a money item of a particular denomination, and a processor configuration operable to determine when an occurrence of the parameter signal falls within the acceptance range, for accepting the money item, wherein said processor configuration is operable to provide a focussed rejection window within said acceptance range and with a disposition dependent on the value of a preceding occurrence of the parameter signal corresponding to a preceding money item, and to provide an output corresponding to the rejection of the money item under test if its corresponding parameter signal falls within the focussed rejection window. The focussed rejection window may span the mean of at least two parameter signals corresponding to preceding money items.

The processor may be operable to compare occurrences of the money item parameter signal with the focussed rejection window until a preselected number of successive ones of the occurrences have values falling outside of the window.

The signal source may be operable to produce a plurality of individual money item parameter signals each as a function of a respective different characteristic of a sensed money item, and the store may be configured to provide data for normal acceptance ranges of values, and any focused rejection or other range of values of parameter signals, individually for each of these respective different characteristics.

The invention further includes a corresponding method for detecting fraudulent coins.

An acceptor according to the invention may be configured for use with coins, banknotes or other money items.

BRIEF DESCRIPTION OF THE DRAWINGS

In order that the invention may be more fully understood an embodiment thereof will now be described by way of example with reference to the accompanying drawings in which.

DETAILED DESCRIPTION

Overview of Coin Acceptor

Figure 1:
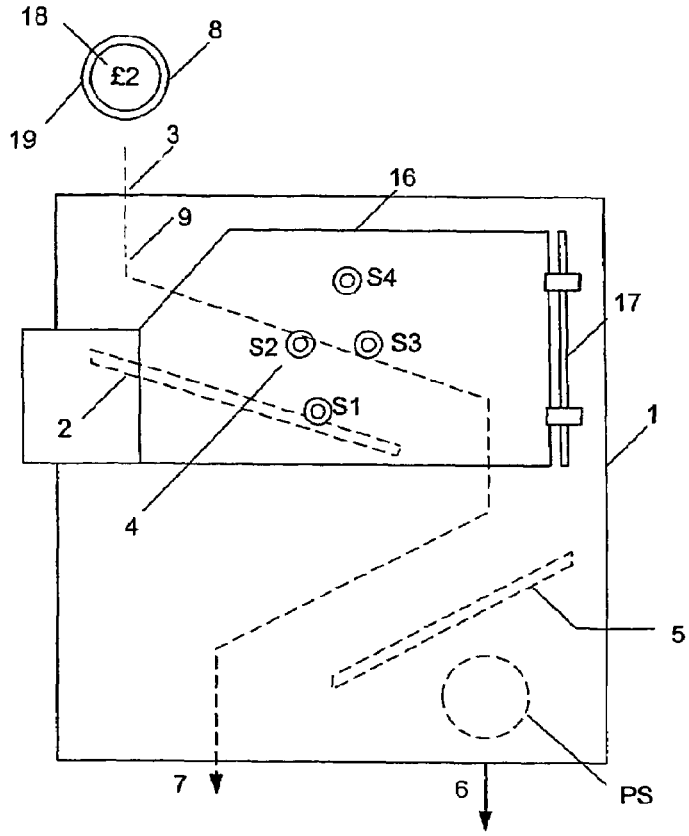
FIG. 1 is a schematic block diagram of a coin acceptor in accordance with the invention.

FIG. 1 illustrates the general configuration of an acceptor according to the invention for use with coins. The coin acceptor is capable of validating a number of coins of different denominations, including bimet coins, for example the euro coin set and the UK coin set including the bimet £2.00 coin. The acceptor includes a body 1 with a coin run-down path 2 along which coins under test pass edgewise from an inlet 3 through a coin sensing station 4 and then fall towards a gate 5. A test is performed on each coin as it passes through the sensing station 4. If the outcome of the test indicates the presence of a true coin, the gate 5 is opened so that the coin can pass to an accept path 6, but otherwise the gate remains closed and the coin is deflected to a reject path 7. The coin path through the acceptor for a coin 8 is shown schematically by dotted line 9.

The coin sensing station 4 includes four coin sensing coil units S1, S2, S3 and S4, which are energised in order to produce an inductive coupling with the coin. Also, a coil unit PS is provided in the accept path 6, downstream of the gate 5, to act as a credit sensor in order to detect whether a coin that was determined to be acceptable, has in fact passed into the accept path 6.

Figure 2:
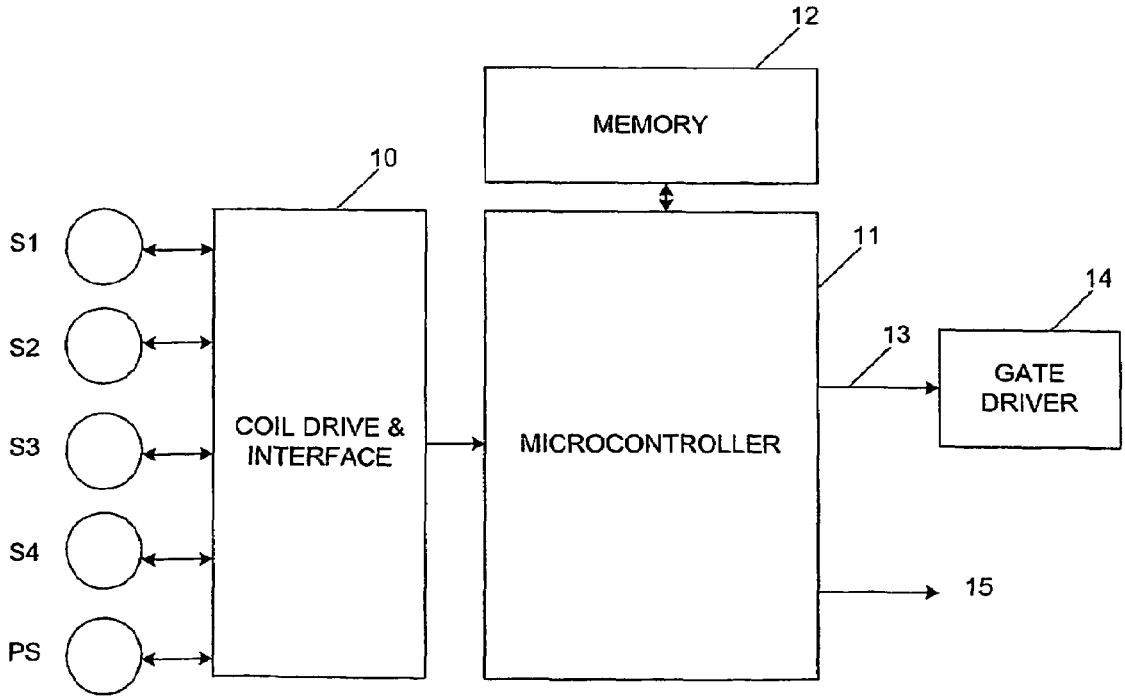
FIG. 2 is a schematic block diagram of the circuits of the acceptor shown in FIG. 1.

The coils are energised at different frequencies by a drive and interface circuit 10 shown schematically in FIG. 2. Eddy currents are induced in the coin under test by the coil units. The different inductive couplings between the four coils and the coin characterise the coin substantially uniquely. The drive and interface circuit 10 produces corresponding digital coin parameter data signals $x_1$, $x_2$, $x_3$, $x_4$, as a function of the different inductive couplings between the coin and the coil units S1, S2, S3 and S4. A corresponding signal is produced for the coil unit PS. The coils S have a small diameter in relation to the diameter of coins under test in order to detect the inductive characteristics of individual chordal regions of the coin. Improved discrimination can be achieved by making the area A of the coil unit S which faces the coin, such as the coil S1, smaller than 72 $mm^2$, which permits the inductive characteristics of individual regions of the coin's face to be sensed.

In order to determine coin authenticity, the coin parameter signals produced by a coin under test are fed to a microcontroller 11 which is coupled to a memory 12. The microcontroller 11 processes the coin parameter signals $x_i$, $-x_4$ derived from the coin under test and compares the outcome with corresponding stored values held in the memory 12. The stored values are held in terms of windows having upper and lower value limits. Thus, if the processed data falls within the corresponding windows associated with a true coin of a particular denomination, the coin is indicated to be acceptable, but otherwise is rejected. If acceptable, a signal is provided on line 13 to a drive circuit 14 which operates the gate 5 shown in FIG. 1 so as to allow the coin to pass to the accept path 6. Otherwise, the gate 5 is not opened and the coin passes to reject path 7.

The microcontroller 11 compares the processed data with a number of different sets of operating window data appropriate for coins of different denominations so that the coin acceptor can accept or reject more than one coin of a particular currency set. If the coin is accepted, its passage along the accept path 6 is detected by the post acceptance credit sensor coil unit PS, and the unit 10 passes corresponding data to the microcontroller 11, which in turn provides an output on line 15 that indicates the amount of monetary credit attributed to the accepted coin.

The sensor coil units S each include one or more inductor coils connected in an individual oscillatory circuit and the coil drive and interface circuit 10 includes a multiplexer to scan outputs from the coil units sequentially, so as to provide data to the microcontroller 11. Each circuit typically oscillates at a frequency in a range of 50-150 kHz and the circuit components are selected so that each sensor coil S1-S4 has a different natural resonant frequency in order to avoid cross-coupling between them.

As the coin passes the sensor coil unit S1, its impedance is altered by the presence of the coin over a period of ~100 milliseconds. As a result, the amplitude of the oscillations through the coil is modified over the period that the coin passes and also the oscillation frequency is altered. The variation in amplitude and frequency resulting from the modulation produced by the coin is used to produce the coin parameter signals $x_1$, -$x_4$ representative of characteristics of the coin.

Processing Circuitry

Figure 3A:
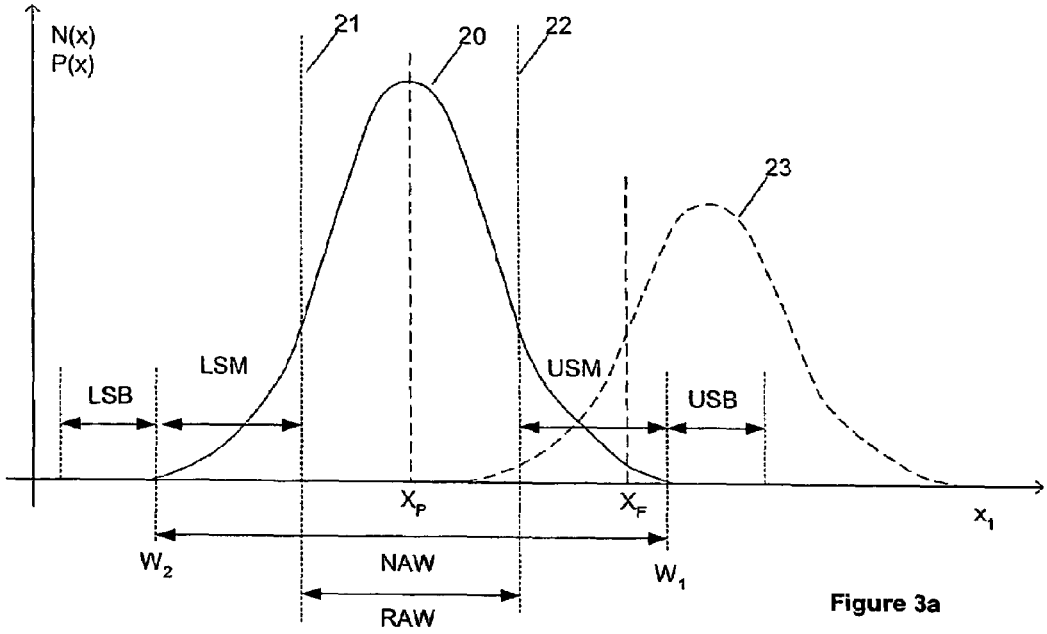
FIG. 3*a* is a distribution curve of coin parameter signals produced by the acceptor of FIG. 1, illustrating a possible distribution produced by counterfeit or foreign coins.

FIG. 3*a* illustrates a bell shaped distribution curve 20 of the values of one of the parameters, $x_1$, produced when a number of coins of the same denomination are passed through the validator. It can be seen that most of the occurrences of the parameter value $x_1$ occur at a peak value $x_p$ and a generally bell shaped distribution occurs around this peak value. The distribution can be determined by passing a number e.g. 100 coins of the same denomination through the validator and recording the corresponding values of $x_1$. The memory 12 stores data corresponding to a window of acceptable values of the parameter $x_1$ for each denomination of coin to be accepted by the validator. In FIG. 3*a*, one of the windows, referred to herein as a normal acceptance window NAW, is shown, extending between upper and lower window limit values $w_1$, $w_2$. The stored data in memory 12 may comprise the upper and lower window limit values $w_1$, $w_2$ themselves or may comprise a mean value and a standard deviation, such that the microcontroller 11 can define the window NAW from the stored data as a predetermined number of standard deviations about the mean.

The graph of FIG. 3*a* can also be considered in a different way. For coins of the true denomination that corresponds to the normal acceptance window (NAW), the most likely value of parameter $x_1$ is the peak value $x_p$ and the least likely value occurs at the upper and lower window limits $w_1$, $w_2$. Whilst it is possible for an acceptable value $x_f$ to occur close to one of the window limits $w_1$, the probability distribution shown in FIG. 3*a* makes it clear that it is unlikely that many such values $x_f$ will occur for the true coin concerned. If several values $x_f$ occur, this is more likely to indicate the presence of a fraudulent distribution 23 as shown in dotted outline, with a peak value centered on or around $x_f$. This property is used in accordance with the invention to discriminate between true coins and a set of frauds that have been manufactured to the same design, or foreign coins, which produce coin parameter values $x_f$ lying within the normal acceptance window NAW. In accordance with the invention, the occurrence of more than one parameter value $x_f$ is considered to be unusual and likely to represent the occurrence of a fraud. A restricted acceptance window RAW shown in FIG. 3*a* is used upon detection of such a situation, as will now be described.

As shown in FIG. 3*a*, upper and lower safety margins LSM, USM are defined in regions of relatively low probability of an occurrence of a parameter value corresponding to a true coin. It will be understood from the distribution curve 20 that it is much more likely for an occurrence of parameter signal $x_1$ to occur between the area of relatively high probability between dotted lines 21, 22 than in the lower and upper safety margins LSM, USM, where there is a relatively low probability of occurrence of a true value. When the microcontroller 11 shown in FIG. 2 detects the presence of a value $x_f$ in either the LSM or USM, it then changes from the normal acceptance window NAW to a restricted acceptance window RAW based on data stored in memory 12, which is narrower than the normal acceptance window, as shown in FIG. 3*a*. In practice, the RAW may correspond to the region of high probability between the dotted lines 21, 22 although different values can be used, which are non-contiguous with the LSM and USM. If the next, subsequent occurrence of the parameter signal $x_1$ produced by the next coin under test, occurs in e.g. the USM, close to the previous value $x_f$, the next coin will be rejected because it lies outside of the restricted acceptance window RAW and is more likely to indicate the presence of a fraudulent coin forming part of the fraudulent coin distribution 23 than the true coin forming part of the distribution 20.

When a first coin under test exhibits a parameter signal $x_f$ within either the upper or lower safety margin, USM, LSM of the normal acceptance window NAW, the coin is accepted as a true coin (assuming that its other detected parameters are satisfactory) but the acceptor then switches to a restricted acceptance window RAW for subsequent coins. The occurrence of the first coin with parameter value $x_f$ sets a flag which may comprise a counter in the microcontroller 11 that counts a coin number parameter n. The acceptor continues to use the restricted acceptance window for a predetermined number of coins n_max set by the counter, and the flag remains set until a number of coins with parameter signals $x_1$ lying within the restricted window RAW occur in succession. The number is dependent upon the distribution of coin data and the probability of a true coin legitimately falling at the limits of the distribution 20. This will vary from coin to coin but typically might be six or eight insertions of coin or could be as few as one or as many as twenty.

If another coin produces a value $x_1$ outside of the restricted acceptance window prior to expiry of the count, the flag is reset and the count begins again. Otherwise, the system reverts to the normal acceptance window NAW after n_max coins with parameter signals within the RAW have been counted.

However, with the system described so far, there is a risk that a fraudster will use true coins in the coin acceptor find out the number n_max loaded into the counter and then insert a fraudulent coin thereafter, which may be accepted if its coin parameter signal falls within the normal acceptance window NAW. According to the invention the count value n_max is changed e.g. increased, each time the system reverts to the normal acceptance window so that the fraudster cannot determine the current value of n_max that is being used by the counter. The processor sets a security timer routine timer_secure, which sets a security time period after which the value of n_max in use is reset to a default value. It is assumed that after the security time period, the fraudster will have given up and gone away, and that is safe to reset the value of n_max Additionally, an upper security barrier USB and a lower security barrier LSB are disposed above and below the upper and lower window limits $w_1$, $w_2$ respectively, as shown in FIG. 3*a*. If a coin produces a parameter signal $x_1$ lying within either the upper or lower security barrier regions USB, LSB, the previously described process is carried out and the acceptor switches from the normal acceptance window NAW to the restricted acceptance window RAW. This process is carried out in order to reject potentially fraudulent coins that form part of a distribution such as the fraudulent distribution 23. For example, it may be possible to find a coin of a foreign denomination which has a close, similar distribution to the true distribution 20, the foreign coin denomination having a distribution 23. The fraudster may attempt to defraud the validator by feeding a series of the foreign coins of the same denomination through the acceptor. With the described arrangement according to the invention, although the first foreign coin would be accepted, those following thereafter would be rejected.

The acceptor may also include a timer which may comprise a routine with a time parameter t run by the microcontrollor 11, that times out after a time period t_max after the restricted acceptance window RAW has been adopted, and returns the acceptor back to the normal acceptance window NAW after the time period t_max. The fraudster may insert a fraudulent coin, get it accepted by the coin acceptor which then switches to use of the restricted acceptance window RAW. If the fraudster then gives up after a few more tries, and goes away, the timer can then time-out in time for an honest user to come and use the acceptor on the basis of the normal acceptance window NAW. However, there is a risk that the fraudster will ascertain the period t_max after which the system reverts from the RAW to the NAW. In accordance with the invention the period t_max is increased when the system reverts to use of the NAW so as to deter the fraudster. The security timer routine timer secure, may be used to set a security time period after which the value of t_max is reset to a default value. It is assumed that after the security time period, the fraudster will have given up and gone away, and that is safe to reset the value of t_max.

Figure 4:
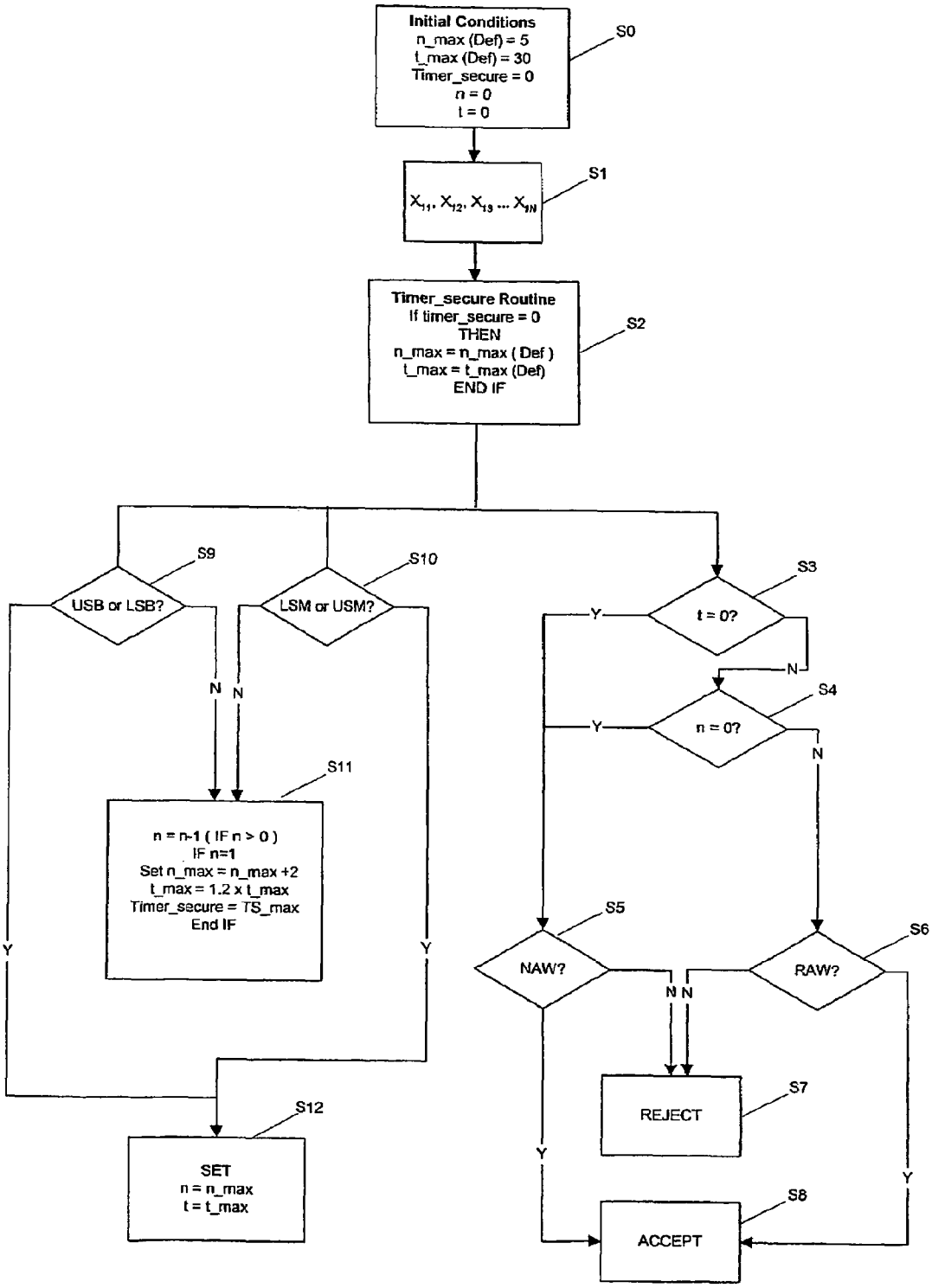
FIG. 4 is a schematic flow diagram of processing steps carried out by the microcontroller 11.

Part of the routine followed by the microcontroller 11 is shown in more detail in FIG. 4. At step S0, the system is initialised. The aforementioned counter is set so that its operating parameter n is initialised i.e. n=0. The default maximum value, n_max (Def), for this counter is also set, in this case to 5. Also, the aforementioned timer has an operating parameter t which can vary from t_max to zero, which indicates a timed-out condition. At step S0 t is initialised i.e. t=0, and the default maximum value t_max (Def), is set, in this case to 30. Furthermore, the time period after which t_max and n_max, having been increased, are reverted back to their default values is initialised i.e. Timer_secure=0.

At step S1, successive values of the parameter signal $x_{11}$, $x_{12}$, . . . $x_{1N}$ are shown. These occurrences of the parameter signal are produced in response to the acceptor testing successive coins one after the other. The successive occurrences of the parameter signal are tested one after the other by the remainder of the routine as will now be explained.

At step S2, t_max and n_max are set to their default values, as previously mentioned, in the case in which Timer_secure=0. This occurs at initialisation of the acceptor and in the case in which the time associated with Timer_secure has elapsed and hence any increases to n_max and t_max are reset.

Considering the first occurrence of the parameter signal $x_{11}$, produced in response to a first coin, at step S3, a test is carried out to see if the timer is active. If it is not active, t=0. This means that a sufficiently long period of time, t_max, has elapsed since a coin fell outside the restricted acceptance window, indicating that it is safe to use the relatively wide, normal acceptance window NAW.

At step S4, the status of the flag counter is checked. If the flag parameter n=0, this means that the flag is not set and that it is safe to use the normal acceptance window NAW. However, if the flag counter is set whilst the timer is running, it is not safe to use the normal acceptance window because the conditions indicate that a previously accepted coin has triggered the flag counter whilst the timer is running. As a result, the value of $x_{11}$ needs to be compared with the restricted acceptance window RAW. This is carried out at step S5. If the value of $x_{11}$ falls within the restricted acceptance window RAW, the coin is accepted at step S8 but otherwise is rejected at step S7.

As previously mentioned, if the timer or the counter flag are set to 0, it is safe to use the normal acceptance window NAW. This test is carried out at step S6 and the coin is either accepted or rejected at step S8 or S7.

In addition to comparing the parameter value against either of the acceptance windows, each occurrence of the parameter value is compared with the upper and lower safety margins and safety barriers. These tests are performed at steps S9 and S10. If the parameter value signal $x_{11}$ falls within any of the barriers or margins USB, USM, LSB, LSM, this indicates that the aforementioned flag needs to be set and that the timer t should be set running. These activities are carried out at step S12, at which the count parameter n is set to a predetermined maximum value n_max. It will be understood that n_max is an integer number corresponding to the number of successive coins which need to be found to be true when using the relatively narrow restricted acceptance window RAW in order to revert to the normal acceptance window. The value of the timer interval t is set to t_max which corresponds to the period of time for which the timer will run until reaching a value t=0. This, therefore sets the time after which the acceptor will recover and switch back to use the normal acceptance window NAW after a period of using the restricted acceptance window RAW (step S3).

If the value of the parameter signal $x_{11}$ does not fall within any of the margins or barriers tested by step S9, S10, this indicates that the parameter signal $x_{11}$, on the assumption that the coin has been accepted, falls within the restricted acceptance window RAW. In this situation, the counter parameter n needs to be decremented, if it is not already zero. This occurs at step S11 in addition to other steps which are described below.

When the count parameter n reaches the value 1, the values of n_max and t_max are increased so that the next fraudulent attempt to occur has an increased number of true insertions and time to have elapsed before reverting to normal acceptance window. The parameters n_max and t_max are therefore increased, for example, by 2 and 20% respectively at step s11. Additionally, the Timer_secure timer is set to a value TS_max. Once this time TS_max has elapsed, n_max and t_max are returned to their respective default values n_max (def), and t_max(def), as previously described, at step S2.

Considering the situation where the first occurrence of the coin parameter signal $x_{11}$ falls within the upper safety margin USM. In this situation, t=0 and n=0 so that the routine passes through steps S3 and S4 to step S6 at which the value is compared with the normal acceptance window NAW. The value of $x_{11}$ falls within the window NAW and hence the coin is accepted at step S8.

Additionally, the value of $x_{11}$ is found to be within the upper safety margin USM, at step S9. As a result, the flag counter parameter n is set to n_max and the timer parameter t is set to t_max at step S12.

When a second coin is entered a second occurrence of the coin parameter signal $x_1$ is produced, namely $x_{12}$. At step S3, the timer is now set to t≠0 and so the process moves to step S4. The parameter n≠0 and so the value of $x_{12}$ is compared with the restricted acceptance window RAW at step S5. The value is either accepted or rejected. Assuming it is accepted, and falls outside of the margins and barriers tested at step S9 and S10, the counter parameter n is decremented at step S11. The timer t is running during this time towards zero.

The process continues with the subsequent occurrences of the parameter $x_1$ so that coins that fall within the RAW decrement the counter flag until the timer t=0 or the counter flag n=0. The acceptor then reverts to the use of the normal acceptance window NAW. When the counter flag n reached 1 however, the values of n_max and t_max were increased, at step s11, becoming 7 and 36 respectively. The Timer_secure timer was also set to TS_max. Should another coin fall outside the restricted acceptance window within the time TS_max, the n_max and t_max values applied to n and t respectively at s12 would now be 7 and 36 respectively. Once TS_max has elapsed these would be reverted to the default values at S2 of 5 and 30 respectively.

In order that the invention may be more fully understood, a description of the processes carried out by the microcontroller in response to a number of coin insertions by a fraudster will now be given, with reference to FIG. 4.

Considering the situation involving the first use of the coin acceptor. The system is primarily initialised at step S0. The default values n_max (Def) and t_max (Def) are set to 5 and 30 respectively and Timer_secure, n and t are each set to 0. A first fraudulent coin is then inserted and the parameter value $x_{11}$ determined and sent to the processor as part of step S1. This triggers the system to move to step S2 at which, because timer_secure=0, n_max is set to n_max (Def) i.e. 5, and t_max is set to t_max (Def) i.e. 30.

The query at step S3 returns a positive outcome as t=0 and the first fraudulent coin parameter is thus compared to the normal acceptance window at step S5. The first fraudulent coin parameter may or may not fall inside the NAW, but in this case it will be assumed that it does. Accordingly, the coin will be accepted at step S8.

The queries at steps S9 and S10 are triggered essentially simultaneously to that of S3. Assuming the fraudulent coin parameter $x_{11}$ falls outside the restricted acceptance window, which is most likely to be the case, $x_{11}$ will hence have fallen within the upper or lower security margins, USM or LSM. Step S10 thus returns a positive value and n and t are set to n_max and t_max at step S12, i.e. 5 and 30 respectively.

The fraudster has now had one fraudulent coin accepted. The fraudster however knows from previous fraudulent attempts on other coin acceptors that the restricted acceptance window will apply until a certain number of true coins have been inserted. To determine this number he inserts progressively larger groups of true coins in succession, each time followed by a fraudulent coin and waits until a fraudulent coin is accepted. Referring to FIG. 4, the first true coin would result in the following processing steps.

The true coin is inserted and the parameter $x_{12}$ determined and sent to the processor at step S1. The IF statement of step S2 is again true as timer_secure=0 and so n_max and t_max are again set to their default values. The queries of steps S3 and S4 return negative responses as t≠0 and n≠0. This results in a comparison of the true coin parameter $x_{12}$ with the restricted acceptance window. The parameter $x_{12}$ falls inside the RAW, as the majority of true coins would, and so it is accepted. Accordingly the parameter $x_{12}$ does not fall within USB, LSB, LSM or USM. Steps S9 and S10 return negative responses and the processor moves to step S11. The variable n=5 is greater than 0 and so n is decremented to n=4. The next IF statement of S11 is untrue as n≠1 and so the processes stop and the system awaits the next coin insertion.

The fraudster might now insert 4 more true coins, guessing that the n_max value for the machine is 5. Each would result in the same processing steps to be taken as the first true coin described above, with n decrementing each time until it reaches 0. However, of the 5 true coin insertions, the $4^{th}$ true coin would also trigger some added events at step S11. When the processing of the fourth coin parameter reaches step S11, n is decremented from n=2 to n=1. This then results in the second IF statement of step S11 being true. Accordingly n_max becomes n_max+2, i.e. 7, and t_max becomes 1.2 t_max i.e. 36. Timer_secure is then set to TS_max, the value of which is not specified in FIG. 4, but could be set to a value larger than t_max.

Now, having inserted 5 true coins, the fraudster may decide to attempt another fraudulent coin. The fraudulent coin is inserted and the parameter $x_{17}$ determined and sent to the processor at step S1. The IF statement of step S2 is false as timer_secure ≠0 and so n_max and t_max remain at the increased values 7 and 36 respectively. The query of step S3 may return a negative response as it could still be at t>0, however, step S4 will now return a positive response because n=0. This results in a comparison of the fraudulent coin parameter $x_{17}$ with the normal acceptance window. The parameter $x_{17}$, although coming from a fraudulent coin, could fall inside this window in which case it would be accepted at step S8. The parameter $x_{17}$ is likely to fall within LSM or USM and so step S10 would accordingly return a positive response and the processor would then move to step S12. At step S12, n is set to n_max and t to t_max, which are the increased values 7 and 36.

The fraudster, using his previously gained knowledge of this coin acceptor, would now insert a further 5 true coins followed by a fraudulent coin expecting this combination, as before, to be accepted. However, as n has now been set to the increased value 7, the restricted acceptance window would still be in operation and the fraudulent coin is therefore most likely to be rejected. This would confuse the fraudster, who may now decide to go away and wait until the normal time t has lapsed, after which, from prior experience, he may know use of the normal acceptance window will be resumed. However, this time has also been increased and so the fraudsters next fraudulent coin would also be rejected. Furthermore, this fraudulent attempt would increase further the values of n_max and t_max. By the time the timer_secure time has lapsed, the fraudster is very likely to have given up with trying to cheat this coin acceptor, and at this stage the use of the default values of n_max and t_max can be resumed.

The previously described process thus relates to one of the coin parameter signals $x_{1N}$. However, as previously explained, four different coin parameter signals $x_1$-$x_4$ are produced in this example and in fact, in practice, up to fourteen different individual parameter signals may be processed. The routine performed according to FIG. 4 may be carried out for each individual coin parameter signal with each having its own normal acceptance window and restricted acceptance window, controlled as previously described, with each parameter signal being processed independently of the others. Alternatively, to simplify the processing, the occurrence of one parameter signal falling within its respective USB, LSB, LSM or USM may trigger the use of an individual restricted acceptance window for all of the coin parameter signals concurrently.

Other modifications are possible. In the routine shown in FIG. 4, the counter flag is clocked downwardly from a first predetermined number n_max. Typically n_max is in a range of 4 to 20 inclusive. Whilst n≠0 the restricted acceptance window RAW is used (step S4). However, when n=0 i.e. when 4 to 20 true coins have been detected, the normal window NAW is used. The occurrence of a single fraudulent coin will then re-trigger the use of the RAW (steps S9, S10 and S12). However, if desired a different pre-selected number p of occurrences of fraudulent coin could be used to reset n=n_max and thereby re-trigger the use of the RAW. The pre-selected number p of occurrences of fraudulent coin is selected to be less than the predetermined number n to thereby improve the sensitivity of the system. Preferably the number p is 1 as described with reference to FIG. 4 to maximise the sensitivity to fraudulent coins, although a larger value of p may in some instances be desirable to provide system damping.

In another modification, the routine may switch from the normal acceptance window NAW to the RAW in response to a coin parameter signal falling within a very narrow portion of the NAW itself, which may signify a fraudulent coin in certain circumstances.

Figure 3B:
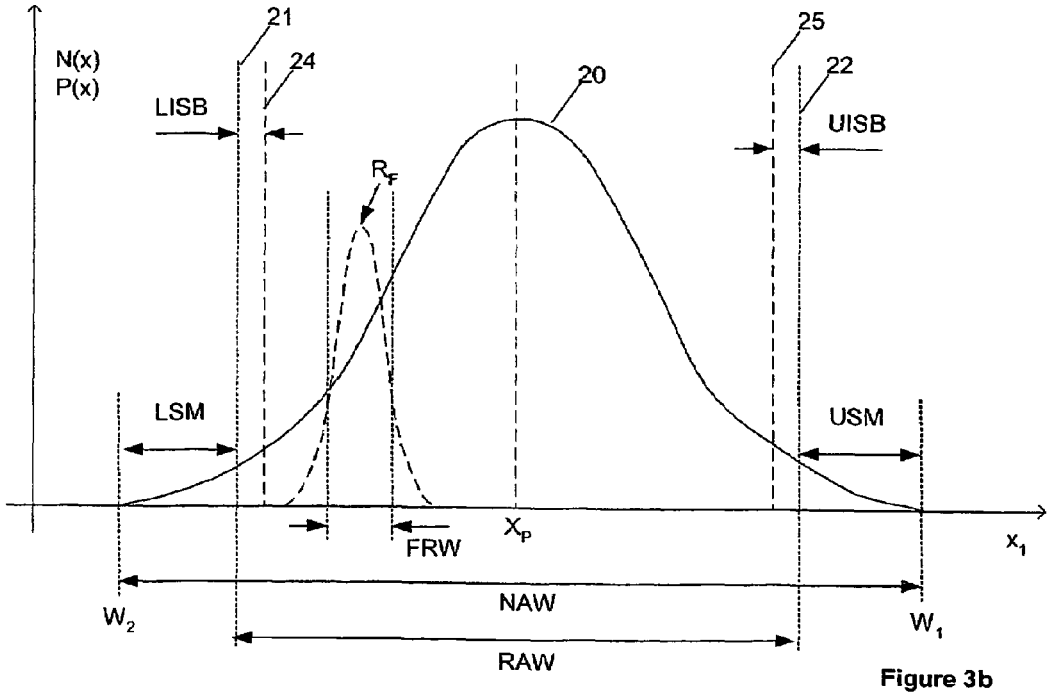
FIG. 3*b* is a distribution curve of coin parameter signals produced by the acceptor of FIG. 1, illustrating a possible distribution produced by a set of true coins of a particular denomination and that of a set of counterfeit coins.

FIG. 3*b*, similar to FIG. 3*a*, illustrates a bell-shaped distribution curve 20 of the values of one of the parameters, $x_1$, produced when a number of coins of the same denomination are passed through the validator. Again, most of the occurrences of the parameter value $x_1$ occur at a peak value $x_P$. The normal and restricted acceptance windows, NAW and RAW, are also illustrated. An upper and lower internal security band, UISB and LISB have been introduced inside the restricted acceptance window RAW. The curve $R_F$ represents the distribution of parameter values $x_1$ produced by many counterfeit coins passed through the validator. This has a relatively sharp peak which lies within the RAW. If several consecutive parameter values $x_F$ occur within a small number of coin insertions and are within one of these bands UISB or LISB, this is more likely to indicate the presence of a fraudulent coin such as those belonging to a distribution such as $R_F$, with a peak centred in one of these bands. For this reason, following the detection of a parameter within either of the internal security bands UISB or LISB, further coins with parameters within these bands will be rejected until a certain number n2_max of coins have been inserted which do not fall within these bands. A counter with count value n2 may be loaded with the value n2_max and decremented following each coin parameter which falls outside UISB and LISB. Once the counter reaches 0, acceptance within UISB and LISB can be resumed.

There is a risk that a fraudster will use true coins in the coin acceptor which do not fall within UISB or LISB, find out the number n2_max loaded into the counter n2, and then insert a fraudulent coin thereafter, which may now be accepted if its coin parameter signal falls within an internal security band. According to the invention the count value n2_max is changed e.g. increased, each time the system returns to acceptance within UISB and LISB so that the fraudster cannot determine the current value of n2_max that is being used by the counter. The processor sets a security timer routine timer_secure2, which sets a security time period after which the value of n2_max in use is reset to a default value. It is assumed that after the security time period, the fraudster will have given up and gone away, and that is safe to reset the value of n2_max to a default value n2_max (Def).

The acceptor may also include a timer which may comprise a routine with a time parameter t2 run by the microcontrollor 11, that times out after a time period t2_max after acceptance within UISB and LISB has been disabled, and the acceptor is then reverted back to enable acceptance. The fraudster may insert a fraudulent coin falling within UISB or LISB, get it accepted by the coin acceptor which then disables UISB and LISB. If the fraudster then gives up after a few more tries, and goes away, the timer can then time-out in time for an honest user to come and use the acceptor with resumed use of UISB and LISB. However, there is a risk that the fraudster will ascertain the period t2_max after which the system reverts from disabled to enabled internal security bands. In accordance with the invention the period t2_max is increased when the system reverts to enabled acceptance within UISB and LISB so as to deter the fraudster. The security timer routine timer_secure2, may be used to set a security time period after which the value of t2_max is reset to a default value. It is assumed that after the security time period, the fraudster will have given up and gone away, and that is safe to reset the value of t2_max to a default value t2_max (Def).

Figure 5:
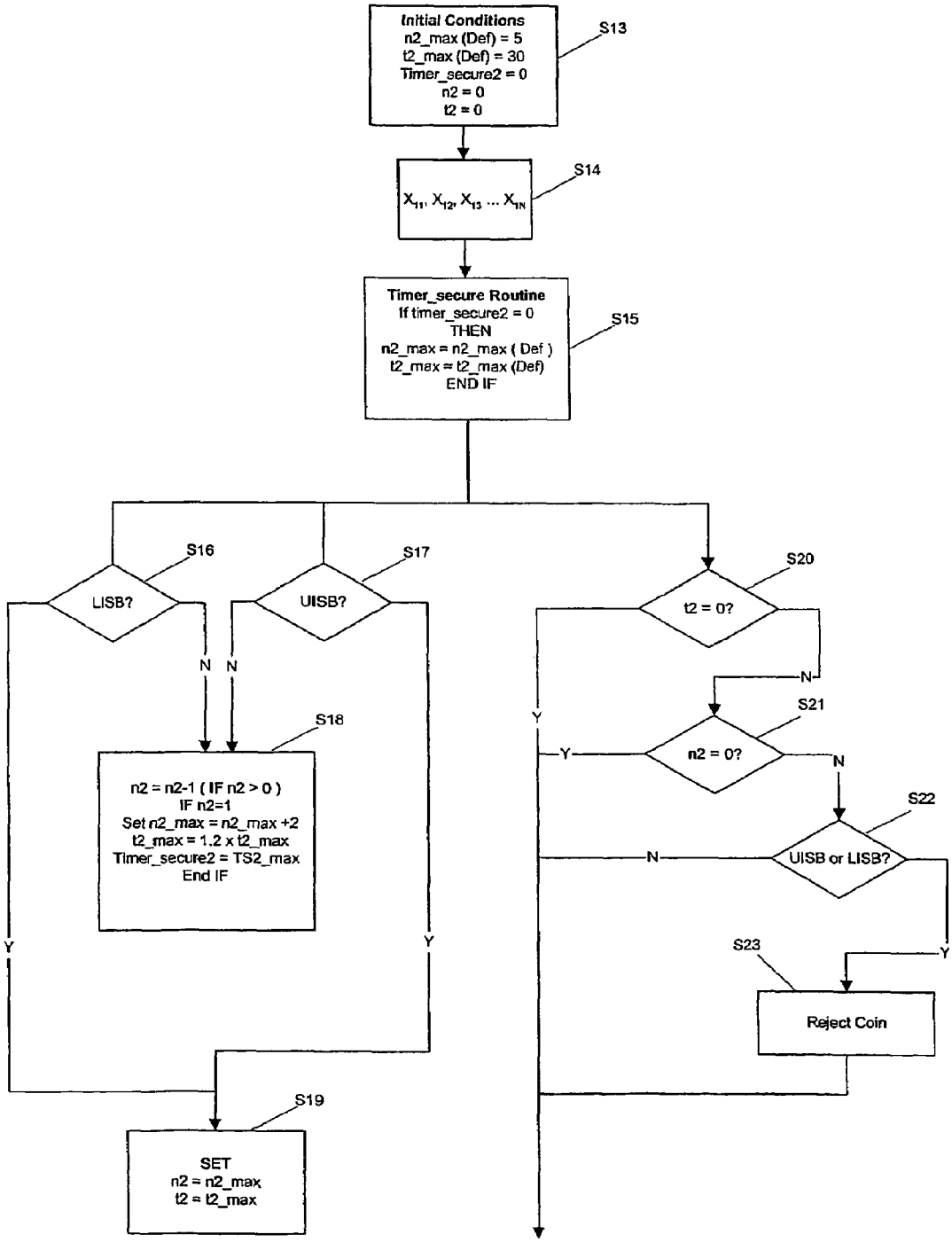
FIG. 5 is a schematic flow diagram of further processing steps carried out by the microcontroller 11 with relation to the upper and lower internal security barriers, UISB and LISB.

An example of the part of the routine followed by the microcontroller 11 with respect to the upper and lower internal security bands is shown in more detail in FIG. 5. This routine may be followed by the microcontroller in conjunction with the routine of FIG. 4 in order that the UISB and LISB aspect is provided as an additional security feature to those features already existing in the normal money item acceptor.

At step S13, the system is initialised. The aforementioned counter is set so that its operating parameter n2 is initialised i.e. n2=0. The default maximum value, n2_max (Def), for this counter is also set, in this case to 5. Also, the aforementioned timer has an operating parameter t2 which can vary from t2_max to zero, which indicates a timed-out condition. At step S13 t2 is initialised i.e. t2=0, and the default maximum value t2_max (Def) is set, in this case to 30. Furthermore, the time period after which t2_max and n2_max, having been increased, are reverted back to their default values is initialised i.e. timer_secure2=0.

At step S14, successive values of the parameter signal $x_{11}$, $x_{12}$, . . . $x_{1N}$ are shown. These occurrences of the parameter signal are produced in response to the acceptor testing successive coins one after the other. The successive occurrences of the parameter signal are tested one after the other by the remainder of the routine as will now be explained.

At step S15, t2_max and n2_max are set to their default values, as previously mentioned, in the case in which timer_secure2=0. This occurs at initialisation of the acceptor and in the case in which the time associated with timer_secure2 has elapsed and hence any increases to n2_max and t2_max are reset.

Considering the first occurrence of the parameter signal $x_{11}$, produced in response to a first coin. At step S20, a test is carried out to see if the timer is active. If it is not active, t2=0. This means that a sufficiently long period of time, t2_max, has elapsed since a coin fell in the UISB or LISB, indicating that it is safe to enable acceptance within these bands. This part of the routine would then finish and the microcontroller would move on to another routine, as shown by the downward arrow at the bottom of FIG. 5.

In the case where t2≠0, at step S21, the status of the flag counter n2 is checked. If the flag parameter n2=0, this means that the flag is not set and that it may be safe to enable acceptance within UISB and LISB. However, if the flag counter is set whilst the timer is running, it is not safe to enable acceptance within UISB and LISB because the conditions indicate that a previously accepted coin has triggered the flag counter whilst the timer is running. As a result, the coin associated with the value $x_{11}$ will be rejected at S23 should it fall within UISB or LISB, the test for which is carried out at step S22.

Each occurrence of the parameter value is compared with the upper and lower internal security bands again at steps S16 and S17. If the parameter value signal $x_{11}$ falls within LISB or UISB, this indicates that the aforementioned flag n2 needs to be set and that the timer t2 should be set running. These activities are carried out at step S19, at which the count parameter n2 is set to a predetermined maximum value n2_max. It will be understood that n2_max is an integer number corresponding to the number of successive coin parameters which need to be found to be outside UISB and LISB before acceptance within UISB and LISB can be resumed. The value of the timer interval t2 is set to t2_max which corresponds to the period of time for which the timer will run until reaching a value t2=0. This, therefore sets the time after which the acceptor will recover and switch back to acceptance within UISB and LISB (step S20).

If the value of the parameter signal $x_{11}$ does not fall within either UISB or LISB as tested by steps S16 and S17, this indicates that the parameter signal $x_{11}$, is not likely to be part of a fraudulent set with parameter values in the outer edge of the RAW. In this situation, the counter parameter n2 needs to be decremented, if it is not already zero. This occurs at step S18 in addition to other steps which are described below.

When the count parameter n2 reaches the value 1, the values of n2_max and t2_max are increased so that the next fraudulent attempt to occur has an increased number of true insertions (those falling outside UISB and LISB) and time to have elapsed before reverting to acceptance within UISB and LISB. The parameters n2_max and t2_max are therefore increased, for example, by 2 and 20% respectively at step S18. Additionally, the Timer_secure2 timer is set to a value TS2_max. Once this time TS2_max has elapsed, n2_max and t2_max are returned to their respective default values n2_max (def), and t2_max(def), as previously described, at step S15.

Considering the situation where the system is initialised at step S13, and the first occurrence of the coin parameter signal $x_{11}$ occurs at S14. At S15, Timer_secure2=0 is true, and hence n2_max and t2_max are set to their default conditions, i.e. 5 and 30 respectively. Assuming $x_{11}$ falls within the upper internal security band UISB. Firstly, the routine may pass to S20. Here, the test t2=0 returns a true response, so this particular routine ends.

Additionally, the value of $x_{11}$ is tested at S16 and S17. The parameter is found to be within the upper internal security band UISB, at step S17. As a result, the flag counter parameter n2 is set to n2_max and the timer parameter t2 is set to t2_max at step S19.

When a second coin is entered a second occurrence of the coin parameter signal $x_1$ is produced, namely $x_{12}$. At step S20, the timer is now set to t2≠0 and so the process moves to step S21. The parameter n2≠0 and so the value of $x_{12}$ is compared with the bands UISB and LISB at S22. The value is rejected should the parameter fall within either of these bands. Assuming it is accepted, and therefore also falls outside of the bands tested at step S16 and S17, the counter parameter n2 is decremented at step S18. The timer t2 is running during this time towards zero.

The process continues with the subsequent occurrences of the parameter $x_1$ so that coins that fall outside the UISB or LISB bands decrement the counter flag until the timer t2=0 or the counter flag n2=0. In the meantime, any parameters falling within UISB or LISB will reset n2 and t2 to n2_max and t2_max at S19. When n2=0 or t2=0, the acceptor then reverts to acceptance within UISB and LISB. When the counter flag n2 reached 1 however, the values of n2_max and t2_max were increased, at step s18, becoming 7 and 36 respectively. The Timer_secure2 timer was also set to TS2_max. Should another coin fall inside UISB or LISB within the time TS2_max, the n2_max and t2_max values applied to n2 and t2 respectively at s19 would now be 7 and 36 respectively. Once TS2_max has elapsed and Timer_secure=0, these would be reverted to the default values at S15 of 5 and 30 respectively.

The previously described process thus relates to one of the coin parameter signals $x_{1N}$. However, as previously explained, four different coin parameter signals $x_1$-$x_4$ are produced in this example and in fact, in practice, up to fourteen different individual parameter signals may be processed. The routine performed according to FIG. 5 may be carried out for each individual coin parameter signal with each having its own upper and lower internal security bands, controlled as previously described, with each parameter signal being processed independently of the others. Alternatively, to simplify the processing, the occurrence of one parameter signal falling within its respective UISB or LISB may disable acceptance within the individual internal security bands for all of the coin parameter signals concurrently.

Other modifications are possible. In the routine shown in FIG. 5, the counter flag n2 is clocked downwardly from a first predetermined number n2_max. Typically n2_max is in a range of 4 to 20 inclusive. Whilst n2≠0, parameters falling within UISB and LISB are rejected (step S21). However, when n2=0 i.e. when 4 to 20 true coins have been detected, acceptance within UISB and LISB is resumed. The occurrence of a single fraudulent coin falling within UISB or LISB will then re-trigger rejection within UISB and LISB (steps S16, S17 and S19). However, if desired a different pre-selected number p of occurrences of fraudulent coin could be used to reset n2=n2_max and thereby re-trigger acceptance within UISB and LISB. The pre-selected number p of occurrences of fraudulent coin is selected to be less than the predetermined number n2 to thereby improve the sensitivity of the system. Preferably the number p is 1 as described with reference to FIG. 5 to maximise the sensitivity to fraudulent coins, although a larger value of p may in some instances be desirable to provide system damping.

In addition to the enhanced security features of the USM, LSM, USB, LSB, UISB and LISB, a further system is applied to minimise to risk of fraud from counterfeit coins. As previously explained, the curve $R_F$ shown in FIG. 3*b*, represents the distribution of parameter values $X_1$ produced by many counterfeit coins passed through the validator. This has a relatively sharp peak which lies within the RAW. If several consecutive parameter values $x_F$ occur within a small number of coin insertions and have a small margin separating them, this is more likely to indicate the presence of a fraudulent coin such as those belonging to $R_F$. In accordance with the invention, a focused rejection window (FRW), as shown in FIG. 3*b*, is applied in addition to the normal acceptance window upon detection of such a situation, as will now be described.

The focused rejection window, FRW, is used in accordance with the invention to discriminate between true coins and a set of frauds that have been manufactured to the same design and which produce coin parameter values $R_F$ lying within the restricted acceptance window RAW. The FRW is calculated to be a relatively narrow window compared to the RAW. In a preferred embodiment of this invention, the range of the focused rejection window is centred at the mean of the two parameter signals, and has limits at, for instance, plus and minus 5% of the mean. The occurrence of the first coin with a parameter value within a small margin of a preceding parameter relating to a preceding coin sets a flag which may comprise a counter (with operating parameter $n_{FRW}$) in the microcontroller 11. The acceptor continues to use the FRW for a predetermined number of coin insertions set by the counter, and the flag remains set until a number of coins with parameter signals $x_1$ lying outside the FRW occur in succession. The number is dependent upon the distribution of coin data and the probability of a true coin legitimately falling within the FRW. This will vary from coin to coin but typically might be six or eight insertions of coin or could be as few as one or as many as twenty.

Figure 6:
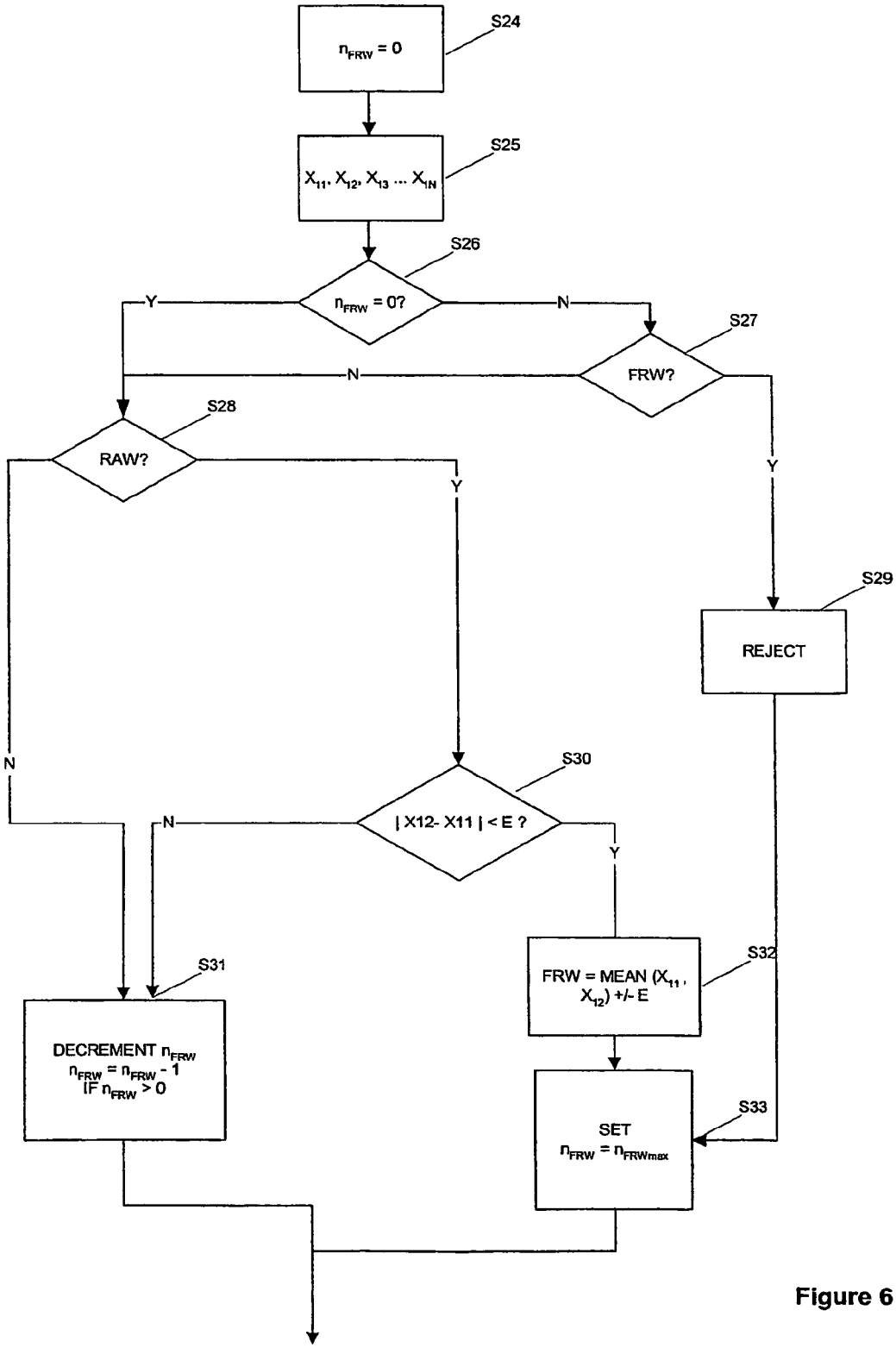
FIG. 6 is a schematic flow diagram of further processing steps carried out by the microcontroller 11 with relation to the focused rejection window FRW.
Figure 7:
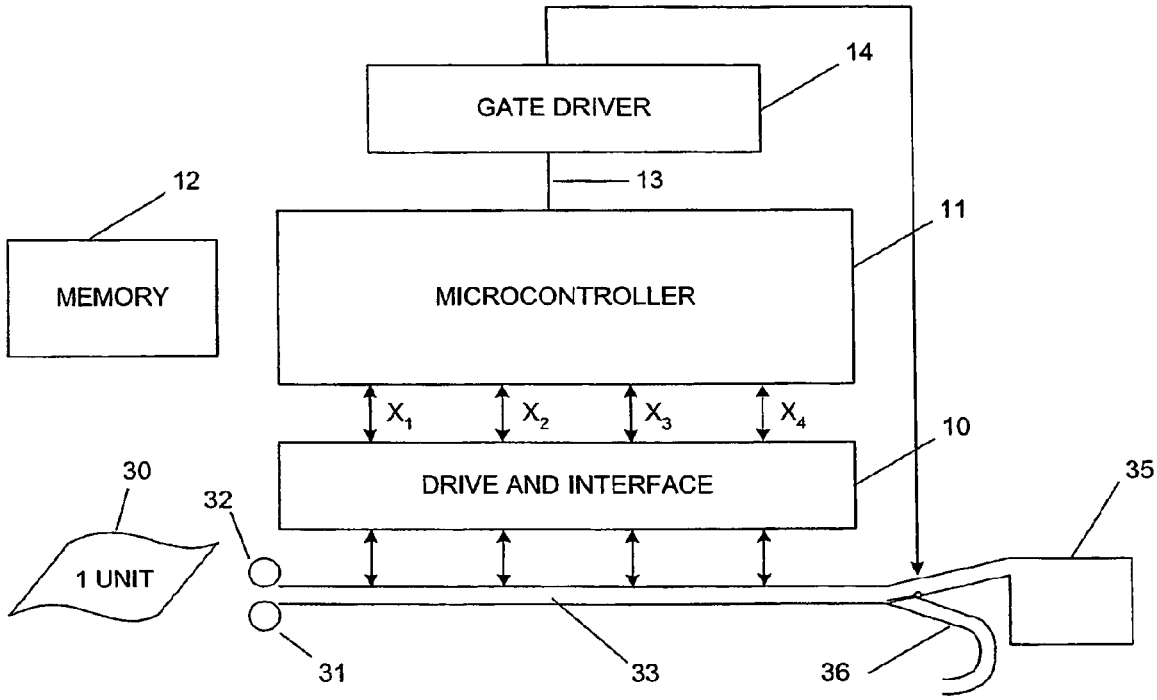
FIG. 7 is a schematic diagram of a banknote acceptor in accordance with the invention.

An example of the part of the routine followed by the microcontroller 11 with respect to the focused rejection window is shown in more detail in FIG. 6.

This routine may be followed in conjunction with the routine of FIG. 4, or the routine of FIG. 5, or in conjunction with the routines of FIGS. 4 and 5. In this manner, the FRW aspect is provided as an additional security feature to those features already existing in the money item acceptor.

Referring to FIG. 6, at step S24, the system is initialised. The aforementioned counter is set so that its operating parameter $n_{FRW}$ is initialised i.e. $n_{FRW}=0$. This counter counts the number of successive coin insertions not falling inside the FRW, which need to take place before use of the FRW is ended.

At step S25, successive values of the parameter signal $x_{11}$, $x_{12}$, . . . $x_{1N}$ are shown. These occurrences of the parameter signal are produced in response to the acceptor testing N successive coins one after the other. The successive occurrences of the parameter signal are tested one after the other by the remainder of the routine as will now be explained.

At step S26, the microcontroller determines whether a focused rejection window is in operation by determining the status of the count flag $n_{FRW}$. If this has the value $n_{FRW}>0$, i.e. the focused rejection window is in operation, then the parameter value $x_{1N}$ is compared to the focused rejection window at S27. Should the parameter value fall within FRW the coin is rejected at S29 and the counter is reset at S33 to a preset maximum value $n_{FRWmax}$.

If, at S26, the value $n_{FRW}=0$, this suggests that a focused rejection window is not in operation and the microcontroller determines whether the parameter falls within the restricted acceptance window RAW at step S28. If this is the case, at S30 it is decided whether or not a new FRW needs to be implemented. In the example of the figure the difference between the coin parameter value $x_{12}$ associated with coin 2 and the parameter value $x_{11}$ associated with coin 1 is determined. However, in another preferred embodiment of this invention this difference would be determined between the parameter associated with the current coin and with a certain number of preceding coins in addition to simply the directly preceding coin as shown. Should this difference be less than the small margin E, the FRW is created at S32. In this example the FRW is determined to be a range centred at the mean of $x_{11}$ and $x_{12}$, although this could be calculated as a larger or smaller range, and with an offset from the mean if desired. At S33 the counter $n_{FRW}$ is set to $n_{FRWmax}$.

Should a coin parameter at S30 not fall within the small margin E of a preceding parameter signal, or if the parameter at S28 does not fall inside the RAW, the counter $n_{FRW}$ is decremented at S31.

Considering the situation where a second coin is inserted into the acceptor which has a coin parameter signal $x_{12}$ which falls within the margin E of the first occurrence of the coin parameter signal $x_{11}$. In this situation, $n_{FRW}=0$ so that the routine passes to step S28 at which the value is compared with the restricted acceptance window RAW. If the value of $x_{12}$ falls within the window then the margin of difference between $x_{11}$ and $x_{12}$ is determined at S30. Assuming this is smaller than E, the FRW is calculated at S32 and at S33 the flag counter parameter $n_{FRW}$ is set to $n_{FRWmax}$.

When a third coin is entered a third occurrence of the coin parameter signal $x_1$ is produced, namely $x_{13}$. At step S26, the counter is now set to $n_{FRW}\neq 0$ and so the process moves to step S27. If the parameter falls within the FRW the coin is rejected at S29 and the counter reset at S33. If the parameter does not fall within the FRW the coin is tested as a normal coin from S28, leading to the counter being decremented or a new FRW implemented if necessary according to the result of step S30.

The process continues with the subsequent occurrences of the parameter $x_1$ until the counter flag $n_{FRW}=0$, at which point the use of the FRW is ended.

In order that the invention may be more fully understood, a description of the processes carried out by the microcontroller in response to a number of coin insertions by a fraudster will now be given, with reference to FIG. 6.

Considering the situation involving the first use of the coin acceptor. The system is primarily initialised at step S24. This may involve the counter $n_{FRW}$ being set to $n_{FRW}=0$, as shown in FIG. 6. The first fraudulent coin is inserted by the fraudster, and a parameter value $x_{11}$ is produced and sent to the processor at step S25. The receipt of this parameter signal triggers the processor to move to step S26 and hence question whether a FRW is currently being used. As $n_{FRW}=0$, the query of S26 returns a positive outcome and the processor moves to step S28. The fraudulent coin that was inserted by the fraudster is assumed to belong to the distribution $R_F$ which is within the restricted acceptance window RAW and accordingly the query S28 returns a positive outcome and the processor moves to step S30. At S30 the parameter $x_{11}$ would be compared to a parameter associated with a preceding coin insertion. However, as no preceding coins exist the system would move to S31. The IF statement of S31 is false as $n_{FRW}=0$ and hence the processor routine stops and the system awaits the next coin entry.

The fraudster may now insert a second fraudulent coin of the distribution $R_F$. At S25 the processor receives the parameter $x_{12}$ associated with this fraudulent coin. The query at step S26 returns a positive outcome because $n_{FRW}=0$, as does the query of S28 because $x_{12}$ is within the RAW. At step S30 the difference between $x_{12}$ and $x_{11}$ is determined and compared to a value E. This value E could be set to be equal to half the FRW width, as is shown in FIG. 6, or another value dependent on the probability associated with having two parameters separated by the value E and produced by true coins. Assuming $x_{12}$ falls within a separation of E from $x_{11}$, the query of S30 returns a positive outcome and the processor moves to step S32. At S32 the FRW is created, being, in this example, set to the mean of the first two parameter signals $x_{11}$ and $x_{12}$ and spanning the range E to either side of this mean. At S33 the counter $n_{FRW}$ is set to a predetermined maximum value, $n_{FRWmax}$, which may be between 4 and 20, and the routine then stops and awaits the next coin entry.

A third fraudulent coin inserted by the fraudster of the distribution $R_F$ results in, at step S25, the processor receiving the parameter $x_{13}$ associated with this fraudulent coin. The query at step S26 now returns a negative response because $n_{FRW}\neq 0$. The query of step S27 checks whether the parameter $x_{13}$ is within the FRW. As $x_{13}$ belongs to the distribution $R_F$ this is likely to be true and therefore a positive response is returned. This results in the coin being rejected at step S29 and the counter value $n_{FRW}$ being reset to $n_{FRWmax}$ at step S33. Any further fraudulent coins of the distribution $R_F$ will be rejected in a similar way until a number $n_{FRWmax}$ of successive coins with parameter signals falling outside this FRW have been inserted.

Although FIG. 6 refers to the use of one focussed rejection window, FRW, and one count parameter $n_{FRW}$, there could equally be multiple focussed rejection windows implemented, each having associated count parameters, so that the system could tackle situations involving more than one fraudulent coin set such as $R_F$.

The previously described process thus relates to one of the coin parameter signals $x_{1N}$. However, as previously explained, four different coin parameter signals $x_1$-$x_4$ are produced in this example and in fact, in practice, up to fourteen different individual parameter signals may be processed. The routine performed according to FIG. 6 may be carried out for each individual coin parameter signal with each having its own restricted acceptance window and focused rejection window, controlled as previously described, with each parameter signal being processed independently of the others.

Other modifications are possible. In the routine shown in FIG. 6, the counter flag is clocked downwardly from a first predetermined number $n_{FRWmax}$. Typically $n_{FRWmax}$ is in a range of 4 to 20 inclusive. Whilst $n_{FRW} \neq 0$ the focused acceptance window FRW is used (step S3). However, when $n_{FRW}=0$ i.e. when 4 to 20 true coins have been detected, the use of the FRW is removed. The occurrence of a single fraudulent coin with a parameter signal which falls within a small margin of a preceding coin's parameter signal will then re-trigger the use of the FRW (steps S30). However, if desired a different pre-selected number p of occurrences of fraudulent coin could be used to reset $n_{FRW}=n_{FRWmax}$ and thereby re-trigger the use of the FRW. The pre-selected number p of occurrences of fraudulent coin is selected to be less than the predetermined number $n_{FRW}$ to thereby improve the sensitivity of the system. Preferably the number p is 1 as described with reference to FIG. 6 to maximise the sensitivity to fraudulent coins, although a larger value of p may in some instances be desirable to provide system damping.

Banknote Acceptor

The previously described routine is also applicable to banknote acceptors and an example is shown in FIG. 6. A banknote 30 to be tested is inserted between driven rollers 31, 32 so as to pass over a sensing platen 33 over which a series of banknote sensors are disposed. In this example, four sensors S1, S2, S3 and S4 are shown schematically. The sensors may include optical sensors for sensing the length, width or thickness of the banknote, sensors for detecting reflected light from the banknote in order to analyse the spectral response. Alternatively, the light may be sensed in transmission through the banknote. One or more individual predetermined parts of the banknote may be measured. Also, the presence of magnetic printing ink may be detected as described in U.S. Pat. No. 4,864,238. The sensors S1-S4 are driven and processed by drive and interface circuitry 10 to produce individual parameter signals $x_1$, $x_2$, $x_3$, $x_4$. These parameter signals are similar to the corresponding signals described with reference to FIGS. 1 and 2 for the coin acceptor although indicative of different parameters relating to a banknote. The resulting signals thus can be processed according to the previously described routine. The parameter signals are passed to a microcontroller 11 connected to a memory 12 that contains stored window values. The parameter signals are compared with stored windows corresponding to acceptable banknotes in the manner previously described with reference to FIGS. 4, 5 and 6, and upon detection of an acceptable banknote, an output is provided on line 13 to a gate driver 14 which operates a gate 34. If the banknote is found to be acceptable, it is passed to a store 35 but otherwise is fed into a reject path 36 and passes out of the acceptor.

Thus, in accordance with the invention, the banknote acceptor is provided with increased security to discriminate against a fraudster inserting a series of fraudulent banknotes all made according to the same design, which individually would fall within the normal acceptance window for an acceptable denomination of banknote.

Whilst the invention has been described by way of example in relation to a coin acceptor and a bank note acceptor it will be understood that it is applicable to other money items such as tokens which are sometimes used instead of coins and other sheet members which have an attributable money value including, but not limited to, credit and debit cards.

The invention claimed is:

1. A money item acceptor comprising:

a signal source to produce a money item parameter signal as a function of a sensed characteristic of a money item, a store to provide data corresponding to a normal acceptance range of values of the parameter signal for a money item of a particular denomination, having high and low acceptance probability regions, wherein the value of the parameter signal corresponds to a high or low probability of an occurrence of a sensed money item of said particular denomination, and a processor configuration operable to control a gate for directing money items towards an accept path or a reject path, the processor configuration further configured to determine when an occurrence of the parameter signal corresponding to a first money item falls outside of the normal acceptance range, and to provide an output to the gate to direct the first money item towards the reject path, to determine when an occurrence of the parameter signal corresponding to the first money item falls within the normal acceptance range and within the low acceptance probability region of the normal acceptance range, and to provide an output to the gate to direct the first money item towards the accept path, and to compare the value of the occurrence of the parameter signal corresponding to the second money item with data corresponding to the restricted acceptance range, and to provide an output to the gate to direct the second money item towards the accept path when the occurrence of the parameter signal corresponding to the second money item falls within said restricted acceptance range, and to provide an output to the gate to direct the second money item towards the reject path when the occurrence of the parameter signal corresponding to the second money item falls outside said restricted acceptance range, said processor configuration being further configured to determine when an occurrence of the parameter signal corresponding to the first money item falls outside of an internal security range of values within the high acceptance probability region and within the normal acceptance range, and to provide an output to the gate to direct the first money item towards the accept path, said processor configuration being further configured to determine when an occurrence of the parameter signal corresponding to the first money item falls within the internal security range of values within said high acceptance probability region of the normal acceptance range, and to provide an output to the gate to direct the first money item towards the accept path, and to compare the value of the parameter signal corresponding to the second money item with data corresponding to said internal security range, and to provide an output to the gate to direct the second money item toward the accept path when the occurrence of the parameter signal corresponding to the second money item falls outside said internal security range and within said high acceptance probability region, and to provide an output to the gate to direct the second money item towards the reject path when the occurrence of the parameter signal corresponding to the second money item falls within said internal security range or outside said high acceptance probability region.

2. An acceptor according to claim 1 wherein, said processor configuration is further configured, in response to said first money item parameter signal falling within the internal security range of values to compare subsequent occurrences of the parameter signal with said internal security range, and when a first number of money items are accepted, to discontinue comparison with the internal security range of values, and, after discontinuing comparison with the internal security range of values, and in response to a subsequent money item parameter signal falling within the internal security range of values, to compare subsequent occurrences of the parameter signal with said internal security range, and when a second number of money items are accepted, to discontinue comparison with the internal security range of values again, the second number being different from the first number.

3. An acceptor according to claim 2 wherein the second number is greater than the first number.

4. An acceptor according to claim 2 wherein the processor is configured to increment said first number by a predetermined amount to define said second number.

5. An acceptor according to claim 2 comprising a counter configured to count said first number and thereafter to count said second number.

6. An acceptor according to claim 5 wherein the processor configuration is configured to reset the count counted by the counter to a default count value in the event that there is no occurrence of a money item parameter signal within a predetermined security time period.

7. An acceptor according to claim 1 wherein the processor configuration is configured to compare occurrences of the money item parameter signal with said internal security range for a first predetermined time period following an occurrence of the money item parameter signal that falls within said internal security range, and then to discontinue comparison with the internal security range.

8. An acceptor according to claim 7 wherein the processor configuration is configured, after discontinuing comparison with the internal security range, to compare occurrences of the money item parameter signal with said internal security range for a second predetermined time period following an occurrence of the money item parameter signal falling within said internal security range, and then to discontinuing comparison with the internal security range, said second time period being greater than the first time period.

9. An acceptor according to claim 8 wherein the processor is configured to define the second time period as a predetermined percentage increase of the first time period.

10. An acceptor according to claim 8 including a timer configured to time said first time period and said second time period.

11. An acceptor according to claim 8 wherein the processor configuration is configured to reset the time period timed by the timer to a default value in the event that there is no occurrence of a money item parameter signal within a predetermined security time period.

* * * * *